US011437184B2

(12) United States Patent
Mori et al.

(10) Patent No.: US 11,437,184 B2
(45) Date of Patent: Sep. 6, 2022

(54) INDUCTOR

(71) Applicant: Murata Manufacturing Co., Ltd., Kyoto-fu (JP)

(72) Inventors: Hiroyasu Mori, Nagaokakyo (JP); Masayuki Takahashi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 406 days.

(21) Appl. No.: 16/817,510

(22) Filed: Mar. 12, 2020

(65) Prior Publication Data

US 2020/0312534 A1 Oct. 1, 2020

(30) Foreign Application Priority Data

Mar. 25, 2019 (JP) ..... JP2019-057162

(51) Int. Cl.
*H01F 27/28* (2006.01)
*H01F 27/29* (2006.01)

(52) U.S. Cl.
CPC ..... *H01F 27/292* (2013.01); *H01F 27/2852* (2013.01)

(58) Field of Classification Search
CPC ..... H01F 27/292; H01F 27/2852
See application file for complete search history.

(56) References Cited

U.S. PATENT DOCUMENTS

2006/0038651 A1* 2/2006 Mizushima ..... H01F 17/04 336/83
2008/0012674 A1* 1/2008 Sano ..... H05K 1/0233 336/83
2010/0253463 A1* 10/2010 Shimomura ..... H01F 27/292 336/200
2010/0289609 A1* 11/2010 Liao ..... B22F 3/12 336/221
2016/0055954 A1* 2/2016 Huang ..... H01F 17/06 336/83
2017/0053732 A1* 2/2017 Moon ..... H01F 17/04

FOREIGN PATENT DOCUMENTS

WO 2009/075110 A1 6/2009

* cited by examiner

*Primary Examiner* — Sherman Ng
(74) *Attorney, Agent, or Firm* — Studebaker & Brackett PC

(57) ABSTRACT

An inductor includes a base body and a metal body. The base body contains magnetic powder. The metal body includes first and second metal units. The first metal unit passes through inside the base body. The second metal unit is continuously provided from both ends of the first metal unit and protrudes from the base body to outside. The second metal unit is used as an outer electrode. In a cross section cut along a direction substantially perpendicular to the longitudinal direction of the first metal unit, the length of external shape lines of the sectional configuration of the first metal unit is about 1000 to 1800 μm, and the area surrounded by the external shape lines is about 40000 to 112500 $\mu m^2$.

20 Claims, 6 Drawing Sheets

INDUCTOR

CROSS-REFERENCE TO RELATED APPLICATION

This application claims benefit of priority to Japanese Patent Application No. 2019-057162, filed Mar. 25, 2019, the entire content of which is incorporated herein by reference.

BACKGROUND

Technical Field

The present disclosure relates to an inductor, and more particularly, to a surface mount inductor.

Background Art

The following surface mount inductor including a base body containing metal magnetic powder and a metal plate embedded in the base body has been proposed in WO2009/075110, for example. The metal plate protrudes from the base body and bends along the side surfaces and the bottom surface of the base body. The metal plate protruding from the base body is used as an outer electrode.

SUMMARY

In this type of known inductor, when a high-frequency current exceeding 1 MHz is input, the quality factor (Q factor) tends to be decreased, thereby increasing a signal loss in the high-frequency region. This is noticeable particularly in small inductors. In a small inductor, the dimensions of a metal plate are limited, which decreases the inductance and increases the electrical resistance.

Accordingly, the present disclosure provides an inductor that is less likely to decrease the Q factor even when a high-frequency current exceeding 1 MHz is input.

An inductor according to an aspect of the present disclosure includes a base body and a metal body. The base body contains magnetic powder. The metal body includes first and second metal units. The first metal unit passes through inside the base body. The second metal unit is continuously provided from both ends of the first metal unit and protrudes from the base body to outside. The second metal unit is used as an outer electrode. In a cross section cut along a direction substantially perpendicular to the longitudinal direction of the first metal unit, the length of external shape lines of the sectional configuration of the first metal unit is about 1000 to 1800 μm, and the area surrounded by the external shape lines is about 40000 to 112500 $\mu m^2$.

An inductor according to another aspect of the present disclosure includes a base body and a metal body. The base body contains magnetic powder. The metal body includes first and second metal units. The first metal unit passes through inside the base body. The second metal unit is continuously provided from both ends of the first metal unit and protrudes from the base body to outside. The second metal unit is used as an outer electrode. In a cross section cut along a direction substantially perpendicular to the longitudinal direction of the first metal unit, the entire length of skin lines corresponding to the skin of a conductor forming the first metal unit is longer than that of external shape lines of the first metal unit by about 4% or greater.

In the inductors configured as described above, the Q factor is less likely to be decreased even when a high-frequency current exceeding 1 MHz is input.

Other features, elements, characteristics and advantages of the present disclosure will become more apparent from the following detailed description of preferred embodiments of the present disclosure with reference to the attached drawings.

DETAILED DESCRIPTION

Figure 1:
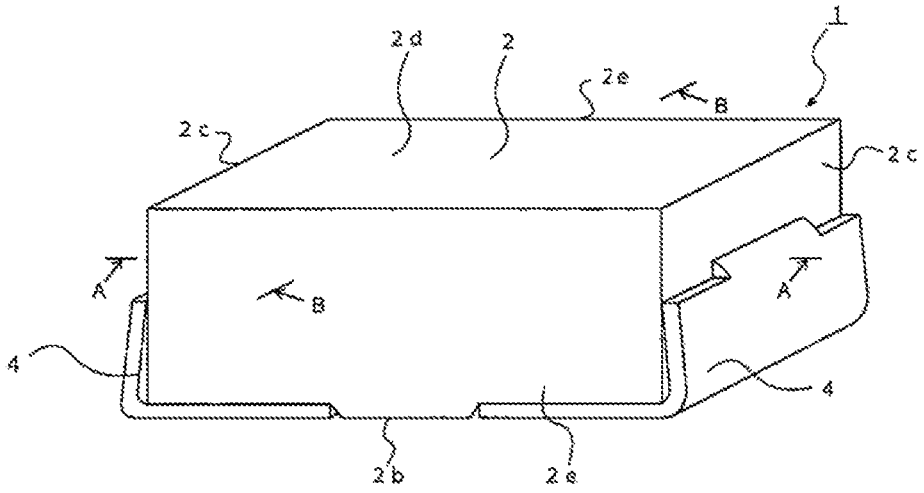
FIG. 1 is a perspective view of an inductor according to a first embodiment of the disclosure.

Embodiments and examples of the disclosure will be described below with reference to the accompanying drawings. Inductors that will be discussed below are examples for taking shape of the technical idea of the disclosure. The disclosure is not restricted to these inductors unless otherwise stated.

In the individual drawings, elements having substantially the same function may be designated by like reference numeral. For the sake of facilitating an explanation and understanding of the main points of the disclosure, the disclosure may be described through illustration of multiple embodiments and examples. Nevertheless, the configurations described in the different embodiments or examples may partially be replaced by or combined with each other. The embodiments and examples will be described mainly by referring to points different from the preceding embodiments while omitting the same points as the preceding embodiments. An explanation of similar advantages obtained by similar configurations will not be repeated. The sizes of the elements and the positional relationships among the elements in the drawings may be illustrated in an exaggerated manner to clarify the representation.

First Embodiment

An inductor 1 according to a first embodiment of the disclosure will first be described below with reference to FIGS. 1 through 3B.

Figure 2A:
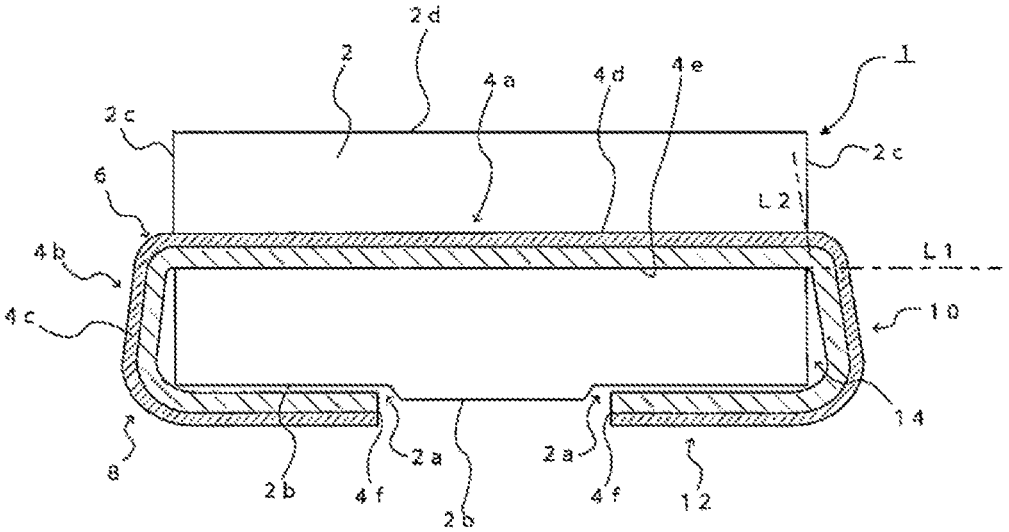
FIG. 2A is a sectional view taken along line A-A in FIG. 1.
Figure 2B:
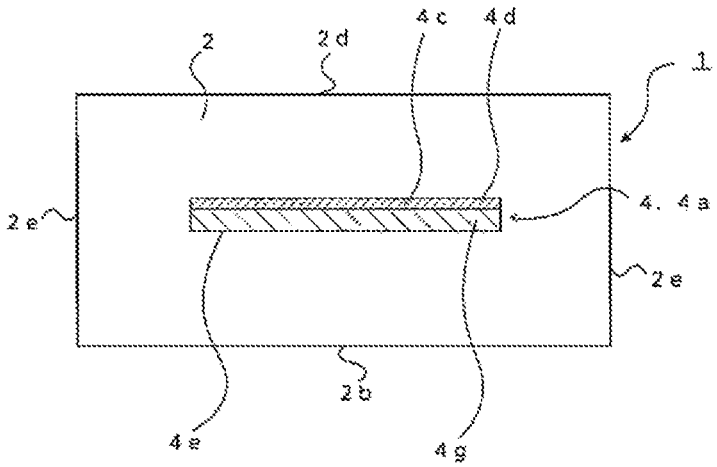
FIG. 2B is a sectional view taken along line B-B in FIG. 1.
Figure 2C:
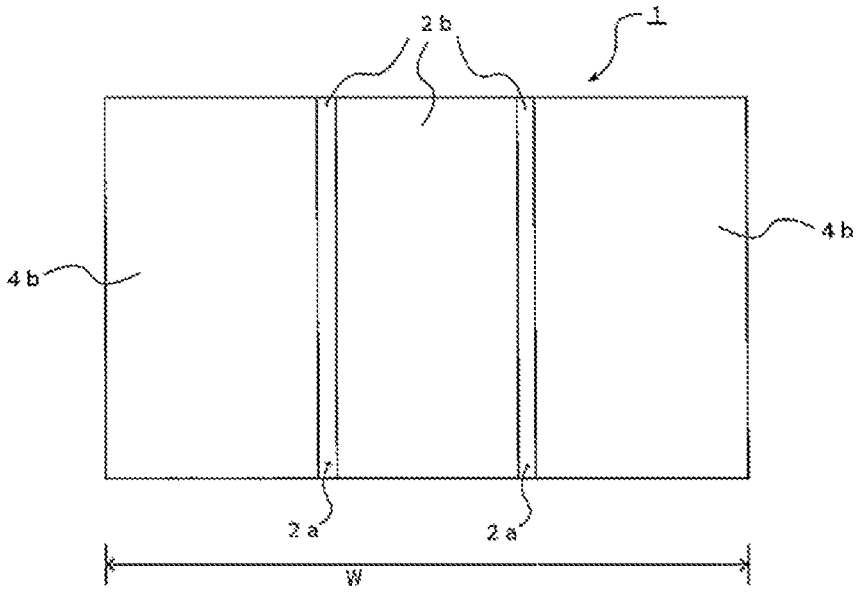
FIG. 2C is a bottom view of the inductor shown in FIG. 1.
Figure 2D:
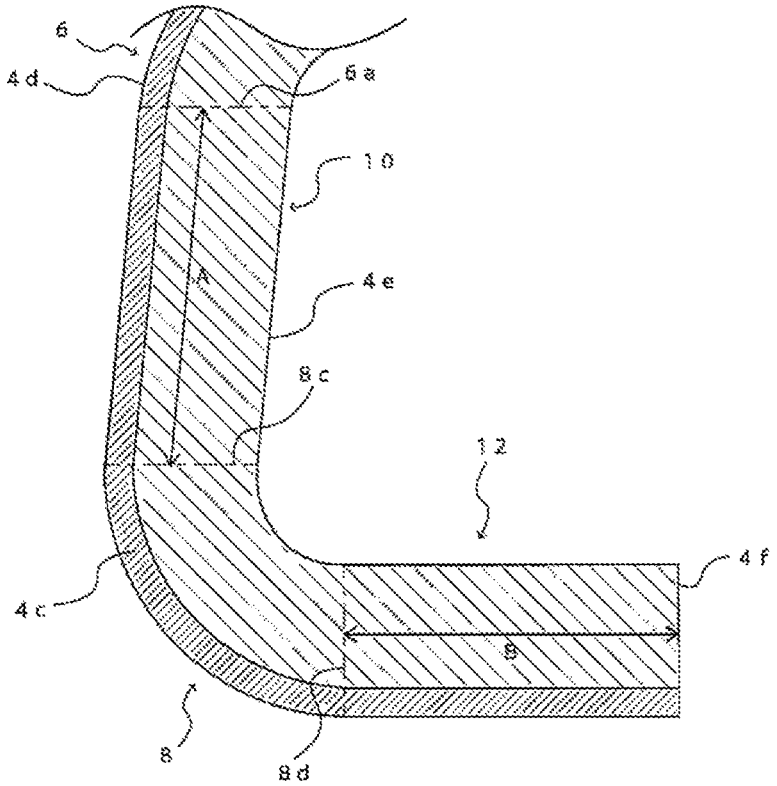
FIG. 2D is an enlarged partial sectional view illustrating the details of a second metal unit shown in FIG. 2A.
Figure 3A:
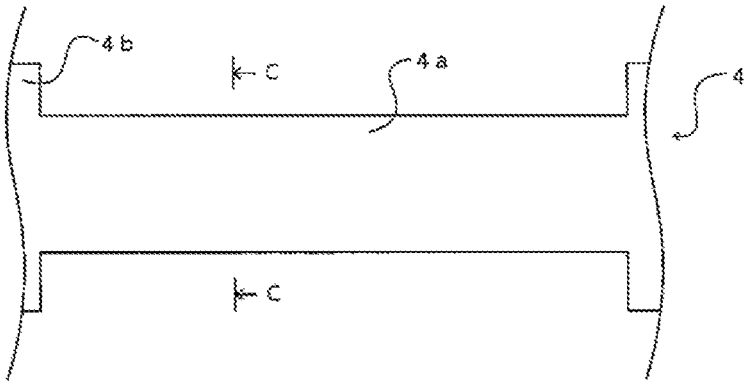
FIG. 3A is a plan view illustrating part of a metal body embedded in the inductor shown in FIG. 1.
Figure 3B:
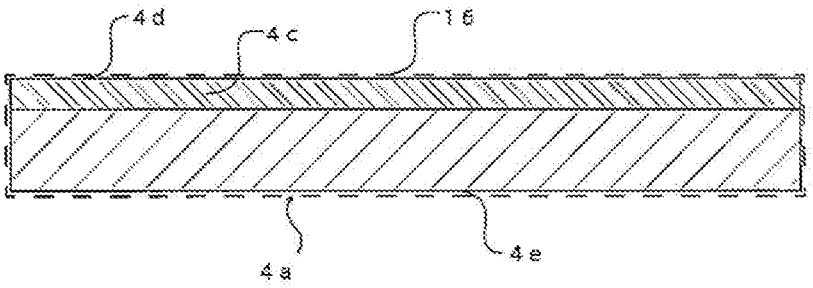
FIG. 3B is a sectional view taken along line C-C in FIG. 3A.

FIG. 1 is a schematic perspective view of the inductor 1 of the first embodiment. FIG. 2A is a sectional view taken along line A-A in FIG. 1. FIG. 2B is a sectional view taken along line B-B in FIG. 1. FIG. 2C is a bottom view of the inductor 1 shown in FIG. 1. FIG. 2D is an enlarged partial sectional view illustrating the details of a second metal unit 4*b* in FIG. 2A. FIG. 3A is a plan view illustrating part of a metal body 4 embedded in the inductor 1 in FIG. 1. FIG. 3B is a sectional view taken along line C-C in FIG. 3A.

The inductor 1 according to the first embodiment, which is a surface mount inductor, includes a base body 2 and a metal body 4. The base body 2 has a bottom surface 2*b*, a top surface 2*d* opposing the bottom surface 2*b*, and two side surfaces 2*c* and two side surfaces 2*e* adjacent to the bottom surface 2*b* and the top surface 2*d*. The metal body 4 includes first and second metal units 4*a* and 4*b*. The first metal unit 4*a* is embedded in the base body 2. The second metal units 4*b* are provided continuously from both ends of the first metal unit 4*a* and protrude from the side surfaces 2*c* of the base body 2 to outside. The metal body 4 has a planar shape having a first surface 4*d* covered with a plating layer 4*c* and a second surface 4*e* opposing the first surface 4*d*. Each second metal unit 4*b* includes first and second bending portions 6 and 8. The first bending portion 6 is formed by bending the second metal unit 4*b* so that the second surface 4*e* opposes the side surface 2*c* of the base body 2. The second bending portion 8 is formed by bending the second metal unit 4*b* so that the second surface 4*e* opposes the bottom surface 2*b* of the base body 2. The second metal unit 4*b* forms an outer electrode which extends along the base body 2 until the bottom surface 2*b* of the base body 2.

(Base Body)

The base body 2 is substantially a rectangular parallelepiped having the bottom surface 2*b*, the top surface 2*d*, the two side surfaces 2*e*, and the two side surfaces 2*c*. The bottom surface 2*b* has substantially a rectangular shape defined by a length (longitudinal direction) and a width (widthwise direction). The top surface 2*d* has substantially a rectangular shape defined by a length (longitudinal direction) and a width (widthwise direction) and opposes the bottom surface 2*b*. The two side surfaces 2*e* have substantially a rectangular shape and are connected to the long sides of the bottom surface 2*b* to oppose each other. The two side surfaces 2*c* have substantially a rectangular shape and are connected to the short sides of the bottom surface 2*b* to oppose each other. The side surfaces 2*c* and the bottom surface 2*b* are substantially perpendicular to each other. Two hollows 2*a* are formed on the bottom surface 2*b* to accommodate part of the second metal units 4*b* of the metal body 4. The hollows 2*a* are disposed at positions closer to the side surfaces 2*c* than to the longitudinal central portion of the bottom surface 2*b*. The bottom surface 2*b* is constituted by lower-height bottom surface portions forming the hollows 2*a* and a higher-height central portion which links the two lower-height bottom surface portions. The length of each of the lower-height bottom surface portions is shorter than half the entire length of the base body 2 and is also longer than or equal to the length of a second straight line portion 12 of the second metal unit 4*b*, which will be discussed later.

The base body 2 is made of a composite material containing magnetic powder. Examples of the magnetic powder are a metal magnetic material containing iron, an amorphous alloy, and metal magnetic particles, such as magnetic nano crystals, and ferrite powder. The composite material may contain a binder, such as a resin. As the binder, a thermosetting resin, such as an epoxy resin, may be used. In accordance with the purpose of use, the base body 2 in the first embodiment is formed to have a length of about 1.6 to 13 mm, a width of about 0.8 to 13 mm, and a height (thickness) of about 0.5 to 13 mm. The height is a distance between the bottom surface 2*b* and the top surface 2*d*. The base body 2 is formed in, for example, the 252010 size, that is, a length of about 2.5 mm, a width of about 2.0 mm, and a height (thickness) of about 1.0 mm.

(Metal Body)

The metal body 4 has substantially a planar shape defined by a length (longitudinal direction) and a width (widthwise direction). The metal body 4 has the first surface 4*d* covered with the plating layer 4*c* and the second surface 4*e* opposing the first surface 4*d*. The metal body 4 includes the first metal unit 4*a* and two second metal units 4*b*. The first metal unit 4*a* is located at the central portion of the metal body 4 in the longitudinal direction. The second metal units 4*b* are continuously provided from the two ends of the first metal unit 4*a* and are disposed at both sides of the metal body 4.

The metal body 4 is constituted by a metal matrix 4*g* and the plating layer 4*c*, as shown in FIG. 2B. The metal matrix 4*g* is made of copper and has a thickness of about 47.25 to 750 μm. The plating layer 4*c* is formed on the entirety of one surface of the metal matrix 4*g*. In the first embodiment, the width of the first metal unit 4*a* is about 400 to 750 μm, and that of the second metal unit 4*b* is about 1200 to 2000 μm. The plating layer 4*c* is formed of a first nickel (Ni) plating layer in contact with the metal matrix 4*g* and a second tin (Sn) plating layer disposed on the first Ni plating layer, for example. In the first embodiment, the first Ni plating layer has a thickness of about 0.5 to 1.0 μm, while the second Sn plating layer has a thickness of about 5 to 9 μm.

(First Metal Unit)

The first metal unit 4*a* has substantially a planar shape defined by a length (longitudinal direction) and a width (widthwise direction). The first metal unit 4*a* is embedded in the base body 2 so that the longitudinal direction of the first metal unit 4*a* substantially matches that of the base body 2, while the widthwise direction of the first metal unit 4*a* substantially matches that of the base body 2. The first metal unit 4*a* passes through inside the base body 2 so that the second surface 4*e* of the first metal unit 4*a* becomes substantially parallel with the bottom surface 2*b* of the base body 2. The first metal unit 4*a* serves as a coil conductor.

The sectional configuration of the first metal unit 4*a* in the widthwise direction is a rectangular shape, as surrounded by external shape lines 16 shown in FIG. 3B. The first metal unit 4*a* is formed such that the entire length of the external shape lines 16 is about 1000 to 1800 μm and the area surrounded by the external shape lines 16 is about 40000 to 112500 $\mu m^2$.

(Second Metal Unit)

The second metal units 4*b* extend from the side surfaces 2*c* of the base body 2 to outside so as to form outer electrodes. Each second metal unit 4*b* includes the first and second bending portions 6 and 8. The first bending portion 6 is formed by bending the second metal unit 4*b* so that the second surface 4*e* opposes the side surface 2*c* of the base body 2. The second bending portion 8 is formed by bending the second metal unit 4*b* so that the second surface 4*e* opposes the bottom surface 2*b* of the base body 2. The width of the second metal unit 4*b* at the first bending portion 6 is substantially the same as that of the first metal unit 4*a*. The width of the second metal unit 4*b* without the first bending portion 6 is longer than that of the first metal unit 4*a*. The width of the second metal unit 4*b* without the first bending portion 6 is substantially the same as or slightly shorter than the width of the base body 2. As shown in FIG. 2D, the length of a first straight line portion 10 (first distance A) is shorter than the distance between the bottom surface 2*b* and the top surface 2*d* of the base body 2 (height of the base body 2) shown in FIG. 2A. The first straight line portion 10 defines the area between an edge 6*a* of the first bending portion 6 closer to a terminating edge 4*f* of the second metal unit 4*b* and an edge 8*c* of the second bending portion 8 closer to the first metal unit 4*a*. As shown in FIG. 2D, the length of a second straight line portion 12 (second distance B) is shorter than half the length W of the base body 2 shown in FIG. 2C. The second straight line portion 12 defines the area between the terminating edge 4*f* of the second metal unit 4*b* and an edge 8*d* of the second bending portion 8 closer to the terminating edge 4*c*. The second straight line portion 12 positioned on the bottom surface 2*b* of the base body 2 is disposed on and connected to wiring of a mounting substrate.

(First Bending Portion)

The first bending portion 6 is formed by bending the second metal unit 4*b* so that the second surface 4*e* of the second metal unit 4*b* opposes the side surface 2*c* of the base body 2. In the first embodiment, as shown in FIG. 2A, the first bending portion 6 is formed so that its interior angle becomes an obtuse angle. The interior angle of the first bending portion 6 is an angle formed by a straight line L1 and a straight line L2 shown in FIG. 2A. The straight line L1 is a line in the longitudinal direction of the second surface 4*e* of the first metal unit 4*a*. The straight line L2 is a line in the longitudinal direction of the second surface 4*e* of the first straight line portion 10, which connects the first and second bending portions 6 and 8. That is, the first bending portion 6 is formed by bending the second metal unit 4*b* so that the second surface 4*e* of the first straight line portion 10 and the side surface 2*c* of the base body 2 do not become parallel with each other, but form a predetermined angle. A gap 14 is thus formed between the first straight line portion 10 and the side surface 2*c* of the base body 2. In the disclosure, however, the first bending portion 6 may be configured in a different manner. For example, the first bending portion 6 may be formed so that its interior angle becomes substantially a right angle by causing the second surface 4*e* of the first straight line portion 10 and the side surface 2*c* of the base body 2 to contact each other.

(Second Bending Portion)

The second bending portion 8 is formed by bending the second metal unit 4*b* so that the second surface 4*e* of the second metal unit 4*b* opposes the bottom surface 2*b* of the base body 2. As shown in FIG. 2A, the second bending portion 8 is formed by bending the second metal unit 4*b* so that the second surface 4*e* of the second straight line portion 12 of the second metal unit 4*b* becomes substantially parallel with the bottom surface 2*b* of the base body 2 where the hollow 2*a* is formed. The entirety of the second straight line portion 12 is accommodated within the hollow 2*a* of the base body 2. If the interior angle of the first bending portion 6 is formed as an obtuse angle, the interior angle of the second bending portion 8 is formed as an acute angle so that the second surface 4*e* of the second straight line portion 12 becomes substantially parallel with the bottom surface 2*b* of the base body 2.

In the inductor 1 configured as described above, the gap 14 is formed between the first straight line portion 10 and the side surface 2*c* of the base body 2. This can reduce a load applied to the second metal unit 4*b* caused by the provision of the first bending portion 6, thereby preventing the occurrence of cracks on the plated surface of the second metal unit 4*b*.

In the inductor 1, the second straight line portion 12 is disposed substantially in parallel with the bottom surface 2*b* of the base body 2 where the hollow 2*a* is formed. This can enhance the mountability of the inductor 1, thereby increasing the bonding strength between the second metal unit 4*b* and a mounting substrate in a mounting operation.

In the inductor 1, the width of the first metal unit 4*a* and that of the second metal unit 4*b* at the first bending portion 6 are shorter than the width of the second metal unit 4*b* at the first straight line portion 10, the second bending portion 8, and the second straight line portion 12. This configuration reduces the force required for forming the first bending portion 6 by bending the metal body 4, thereby relaxing a stress applied to the base body 2.

In the inductor 1, the second metal unit 4*b*, which is part of the metal body 4, extending from the side surface 2*c* of the base body 2 is used as an outer electrode. The provision of a separate outer electrode is not required. The widths of the second metal unit 4*b* at the first straight line portion 10, the second bending portion 8, and the second straight line portion 12 are elongated, thereby making it possible to enlarge the surface of the outer electrode to be electrically connected.

In the inductor 1, the first distance A is shorter than the height of the side surface 2*c* of the base body 2 in a direction perpendicular to the bottom surface 2*b*. Hence, the area between the edge 6*a* of the first bending portion 6 closer to the terminating edge 4*f* of the second metal unit 4*b* and the edge 8*c* of the second bending portion 8 closer to the first metal unit 4*a* can be formed within the first straight line portion 10. This ensures that the second metal unit 4*b* can reliably be clamped with a die in bending processing. Additionally, in the inductor 1 configured as described above, the second distance B is shorter than half the distance between the opposing side surfaces 2*c* of the base body 2. This can prevent the two second straight line portions 12 from contacting each other on the bottom surface 2*b* of the base body 2, which would otherwise cause short-circuiting therebetween.

In the inductor 1, the plating layer 4*c* constituted by the first Ni plating layer which contacts the metal matrix 4*g* and the second Sn plating layer on the first Ni plating layer is disposed on the first surface 4*d* of the metal body 4. This can improve the solder wettability of the second metal unit 4*b*, which serves as an outer electrode, thereby achieving high-reliability mounting.

(Relationship Between Designing of First Metal Unit and Performance of Inductor)

The relationship between the first metal unit 4*a*, which serves as a coil conductor, and the performance of the inductor 1 will be discussed below.

It is known that the quality factor (Q factor) of an inductor (coil) is inversely proportional to the resistance of the coil, as expressed by equation (1):

$$Q = \frac{2\Pi fL}{R} \quad (1)$$

where f is the frequency of a current and R is the resistance.

The resistance of the inductor (coil) is inversely proportional to the sectional area cut along the direction substantially perpendicular to the longitudinal direction of the first metal unit 4*a*. If the area surrounded by the external shape lines 16 shown in FIG. 3B is greater than or equal to a predetermined value, the resistance may be reduced.

When the frequency of an input current I becomes higher, because of the skin effect, the current I is less likely to flow through the area separated from the surface of the first metal unit 4*a*, and the electrical resistance accordingly becomes higher. The entire length of the external shape lines 16 is proportional to the surface area where the current I concentrates and flows because of the skin effect. If the entire length of the external shape lines 16 is greater than or equal to the predetermined value, a sufficiently large surface area can be obtained. With such a sufficient surface area, a high-frequency current I may safely flow through the first metal unit 4*a* while reducing the electrical resistance.

Based on the above-described assumption, tests using an actual machine and simulations have been conducted. As a result, it has been discovered that, if the length of the external shape lines 16 is about 1000 μm or longer and if the area surrounded by the external shape lines 16 is about 40000 $\mu m^2$ or larger in a widthwise cross section of the first metal unit 4*a*, magnetic flux Φ (Φ=L×I) which is sufficient for a practical application can be obtained in the inductor 1 even with input of a high-frequency current exceeding 1 MHz. In the inductor 1 according to the first embodiment, the electrical resistance can be reduced without decreasing the inductance L, thereby making it possible to increase the Q factor.

On the other hand, however, in a widthwise cross section of the first metal unit 4*a*, if the length of the external shape lines 16 is too long or the area surrounded by the external shape lines 16 is too large, an excessively large force is required for bending a metal plate (second metal unit 4*b*) in bending processing. This may cause the occurrence of cracks on the plated surface of the outer electrode. This may lead to a decrease in solder wettability of the outer electrode and thus cause poor soldering when the outer electrode is mounted on a mounting substrate. The base body 2 may also be broken. Additionally, the ratio of a widthwise cross section of the first metal unit 4*a* to that of the base body 2 is increased, thereby decreasing the area through which magnetic flux flows and accordingly reducing the inductance.

Based on the above-described assumption, tests using an actual machine and simulations have been conducted. As a result, it has been discovered that, if the length of the external shape lines 16 is about 1800 μm or shorter and if the area surrounded by the external shape lines 16 is about 112500 $\mu m^2$ or smaller in a widthwise cross section of the first metal unit 4*a*, an excessively large force is not required for bending the metal body 4. As a result, the occurrence of cracks on the plated surface of the outer electrode and a breakage in the base body can be prevented without reducing the inductance.

As described above, the inductor 1 according to the first embodiment includes the base body 2 and the metal body 4. The base body 2 contains magnetic powder. The metal body 4 includes first and second metal units 4*a* and 4*b*. The first metal unit 4*a* passes through inside the base body 2. The second metal unit 4*b* is continuously provided from both ends of the first metal unit 4*a* and protrudes from the base body 2 to outside. The second metal unit 4*b* is used as an outer electrode. In a cross section cut along a direction substantially perpendicular to the longitudinal direction of the first metal unit 4*a* (see FIG. 2B), the length of the external shape lines of the sectional configuration of the first metal unit 4*a* is about 1000 to 1800 μm, and the area surrounded by the external shape lines is about 40000 to 112500 $\mu m^2$.

(Advantages)

Even when a high-frequency current is input, the Q factor is not decreased.

As described above, in an inductor handling a high-frequency current, the flowing of a high current I through the inductor is effective in generating a sufficient level of magnetic flux Φ. To input a high current I, increasing of the surface area is effective. However, increasing the surface area enlarges the external shape of the first metal unit 4*a* and accordingly increases the ratio of a widthwise cross section of the first metal unit 4*a* to that of the base body 2. This decreases the area through which magnetic flux flows and accordingly reduces the inductance. The bending of the metal body 4 also becomes difficult. It is thus advantageous if the surface area is increased while maintaining the external shape of the first metal unit 4*a*.

As a result of conducting tests using an actual machine and simulations, the following findings have been made. In a widthwise cross section cut along the direction substantially perpendicular to the longitudinal direction of the first metal unit 4*a*, if the entire length of the skin lines corresponding to the skin of a conductor forming the first metal unit 4*a* is longer than that of the external shape lines of the first metal unit 4*a* by about 4% or greater, the surface area can be increased while maintaining the external shape of the first metal unit 4*a*, and the effect of reducing the electrical resistance can sufficiently be exhibited.

In the following embodiments, the structure that makes it possible to effectively increase the surface area while maintaining the external shape of a first metal unit will be discussed in detail.

Second Embodiment

Figure 4:
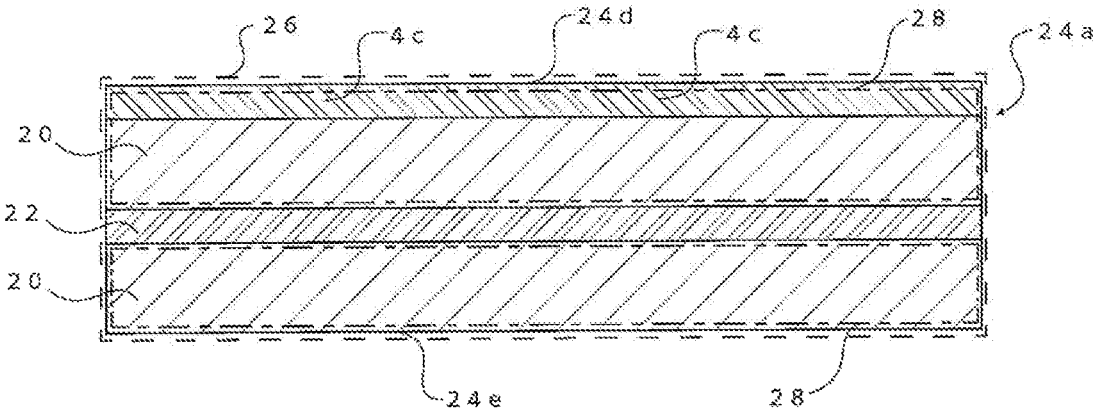
FIG. 4 is a sectional view illustrating part of a metal body of an inductor according to a second embodiment of the disclosure.

An inductor 21 according to a second embodiment of the disclosure will be described below with reference to FIG. 4. FIG. 4 is a schematic sectional view of a first metal unit 24*a* of the inductor 21 according to the second embodiment. As in FIG. 3B, FIG. 4 illustrates a sectional configuration of the first metal unit 24*a* in the widthwise direction. The inductor 21 of the second embodiment is different from the inductor 1 of the first embodiment in that the configuration of the first metal unit 24*a* is different from that of the first metal unit 4*a*. In FIG. 4, the same elements as those of the inductor 1 are designated by like reference numerals.

(First Metal Unit)

The first metal unit 24*a* is constituted by multiple metal plates 20 stacked on each other in the thickness direction. An insulating member 22 is disposed between the metal plates 20 so as to insulate the metal plates 20 from each other. The first metal unit 4*a* in the first embodiment may be used as each metal plate 20. Among the metal plates 20, the metal plate 20 located at the outermost position and having a first surface 24*d* of the first metal unit 24*a* is covered with a plating layer 4*c*.

As shown in FIG. 4, the widthwise sectional configuration of the first metal unit 24*a* formed by the multiple metal plates 20 is a rectangular shape surrounded by external shape lines 26. The first metal unit 24*a* is embedded in the base body 2 so that a second surface 24*e* of the first metal unit 24*a* becomes substantially parallel with the bottom surface 2*b* of the base body 2. Among the plural metal plates 20, the second surface 24*e* is a surface of the metal plate 20 positioned opposite the metal plate 20 covered with the plating layer 4*c*.

The length of the first metal unit 24*a* is substantially the same as that of the base body 2. The width of the first metal unit 24*a* is shorter than that of the base body 2. The first metal unit 24*a*, as well as the first metal unit 4*a*, serves as a coil conductor in the inductor 21.

(Advantages)

Focusing on skin lines 28, indicated by the long dashed dotted lines in FIG. 4, corresponding to the skin of the multiple metal plates 20 forming the first metal unit 24*a*, and external shape lines 26 of the first metal unit 24*a* indicated by the broken lines in FIG. 4, the entire length of the skin lines 28 is found to be longer than that of the external shape lines 26. That is, the first metal unit 24*a* configured as described above can increase its surface area to be larger than a first metal unit constituted by one metal plate having substantially the same external shape as the first metal unit 24*a*. The first metal unit 24*a* can thus reduce the electrical resistance. The surface area of the first metal unit 24*a* can be increased while the size of the sectional area is substantially maintained, so that the electrical resistance can be reduced without decreasing the inductance L.

Third Embodiment

Figure 5A:
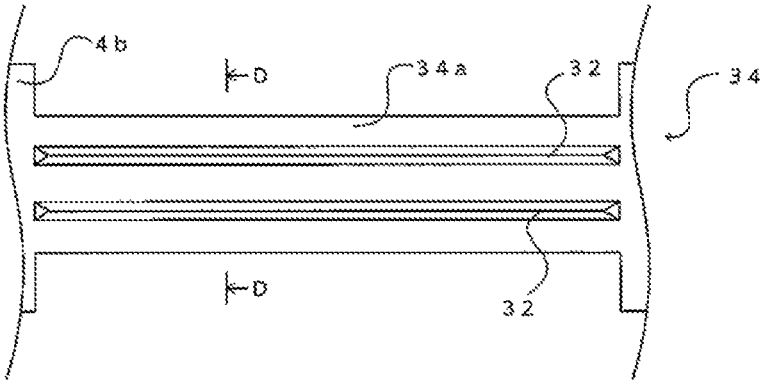
FIG. 5A is a plan view illustrating part of a metal body of an inductor according to a third embodiment of the disclosure.
Figure 5B:
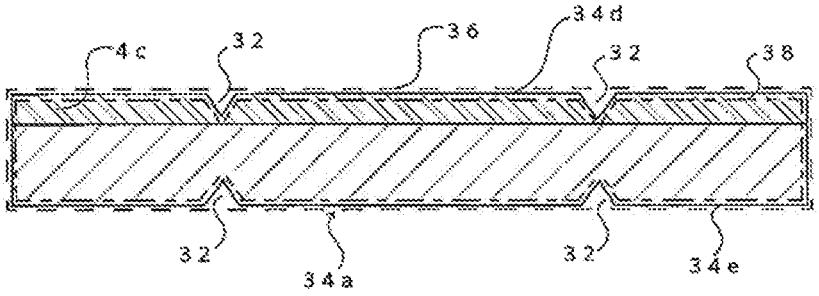
FIG. 5B is a sectional view taken along line D-D in FIG. 5A.

An inductor 31 according to a third embodiment of the disclosure will be described below with reference to FIGS. 5A and 5B. FIG. 5A is a schematic plan view of a first metal unit 34*a* of the inductor 31 according to the third embodiment. FIG. 5B is a schematic sectional view taken along line D-D in FIG. 5A. The inductor 31 of the third embodiment is different from the inductor 1 of the first embodiment in that the configuration of the first metal unit 34*a* is different from that of the first metal unit 4*a*. In FIGS. 5A and 5B, the same elements as those of the inductor 1 are designated by like reference numerals.

(First Metal Unit)

As in the first metal unit 4*a* in the first embodiment, the first metal unit 34*a* has substantially a planar shape defined by a length (longitudinal direction) and a width (widthwise direction). The first metal unit 34*a* is embedded in the base body 2 so that a second surface 34*e* of the first metal unit 34*a* becomes substantially parallel with the bottom surface 2*b* of the base body 2. The first metal unit 34*a* serves as a coil conductor in the inductor 31. The length of the first metal unit 34*a* is substantially the same as that of the base body 2. The width of the first metal unit 34*a* is shorter than that of the base body 2.

As shown in FIGS. 5A and 5B, the first metal unit 34*a* has grooves 32 extending in the longitudinal direction on a first surface 34*d* and the second surface 34*e*. The depth of the grooves 32 is smaller than half the thickness of the first metal unit 34*a*. Although the two grooves 32 are shown in FIGS. 5A and 5B, more than or less than two grooves 32 may be formed in the first metal unit 34*a*. The grooves 32 may be formed on only one of the first and second surfaces 34*d* and 34*e*. The number of grooves 32 formed on the first surface 34*d* and that on the second surface 34*e* may be different from each other.

(Advantages)

Focusing on skin lines 38, indicated by the long dashed dotted lines in FIG. 5B, corresponding to the skin of the metal plate forming the first metal unit 34*a*, and external shape lines 36 of the first metal unit 34*a* indicated by the broken lines in FIG. 5B, the entire length of the skin lines 38 is found to be longer than that of the external shape lines 36. That is, the first metal unit 34*a* configured as described above can increase its surface area to be larger than a first metal unit constituted by a metal plate without grooves and having substantially the same external shape as the first metal unit 34*a*. The first metal unit 34*a* can thus reduce the electrical resistance. The surface area of the first metal unit 34*a* can be increased while the size of the sectional area is substantially maintained, so that the electrical resistance can be reduced without decreasing the inductance L.

Fourth Embodiment

Figure 6A:
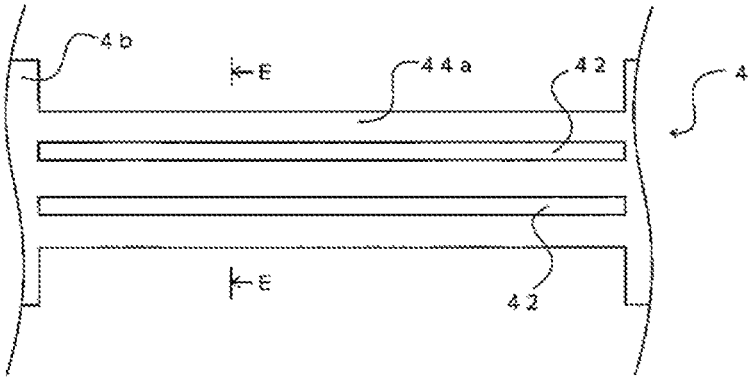
FIG. 6A is a plan view illustrating part of a metal body of an inductor according to a fourth embodiment of the disclosure.
Figure 6B:
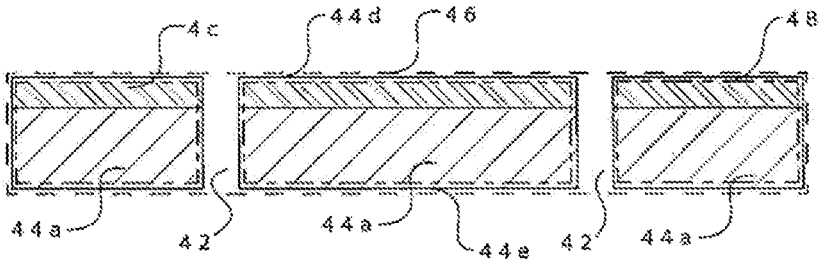
FIG. 6B is a sectional view taken along line E-E in FIG. 6A.

An inductor 41 according to a fourth embodiment of the disclosure will be described below with reference to FIGS. 6A and 6B. FIG. 6A is a schematic plan view of a first metal unit 44*a* of the inductor 41 according to the fourth embodiment. FIG. 6B is a schematic sectional view taken along line E-E in FIG. 6A. The inductor 41 of the fourth embodiment is different from the inductor 1 of the first embodiment in that the configuration of the first metal unit 44*a* is different from that of the first metal unit 4*a*. In FIGS. 6A and 6B, the same elements as those of the inductor 1 are designated by like reference numerals.

(First Metal Unit)

As in the first metal unit 4*a* in the first embodiment, the first metal unit 44*a* has substantially a planar shape defined by a length (longitudinal direction) and a width (widthwise direction). The first metal unit 44*a* is embedded in the base body 2 so that a second surface 44*e* of the first metal unit 44*a* becomes substantially parallel with the bottom surface 2*b* of the base body 2. The first metal unit 44*a* serves as a coil conductor in the inductor 41. The length of the first metal unit 44*a* is substantially the same as that of the base body 2. The width of the first metal unit 44*a* is shorter than that of the base body 2.

As shown in FIGS. 6A and 6B, the first metal unit 44*a* has slits 42 extending in the longitudinal direction. The slits 42 pass through the first metal unit 44*a* from a first surface 44*d* to the second surface 44*e*. Although the two slits 42 are shown in FIGS. 6A and 6B, more than or less than two slits 42 may be formed.

(Advantages)

Focusing on skin lines 48, indicated by the long dashed dotted lines in FIG. 6B, corresponding to the skin of the metal plate forming the first metal unit 44*a*, and external shape lines 46 of the first metal unit 44*a* indicated by the broken lines in FIG. 6B, the entire length of the skin lines 48 is found to be longer than that of the external shape lines 46. That is, the first metal unit 44*a* configured as described above can increase its surface area to be larger than a first metal unit constituted by a metal plate without slits and having substantially the same external shape as the first metal unit 44*a*. The first metal unit 44*a* can thus reduce the electrical resistance. The surface area of the first metal unit 44*a* can be increased while the size of the sectional area is substantially maintained, so that the electrical resistance can be reduced without decreasing the inductance L.

Fifth Embodiment

Figure 7:
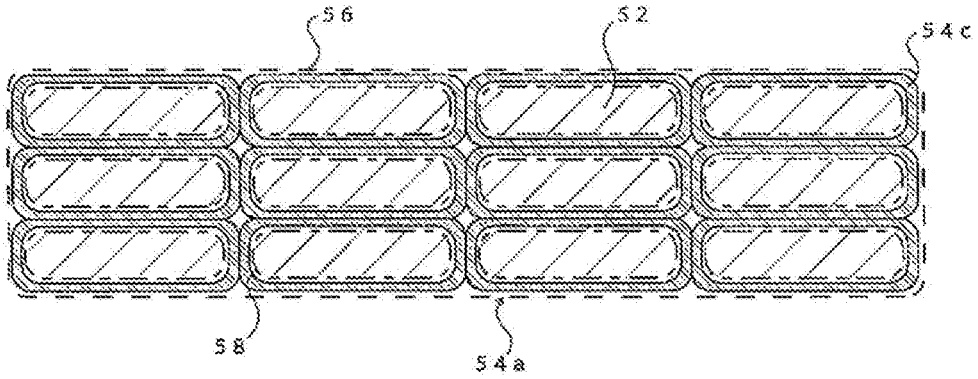
FIG. 7 is a sectional view of a first metal unit of an inductor according to a fifth embodiment of the disclosure in a direction substantially perpendicular to the longitudinal direction.

An inductor 51 according to a fifth embodiment of the disclosure will be described below with reference to FIG. 7. FIG. 7 is a schematic sectional view of a first metal unit 54*a* of the inductor 51 in a direction substantially perpendicular to the longitudinal direction. The inductor 51 of the fifth embodiment is different from the inductor 1 of the first embodiment in that the configuration of the first metal unit 54*a* is different from that of the first metal unit 4*a*. In FIG. 7, the same elements as those of the inductor 1 are designated by like reference numerals.

(First Metal Unit)

The first metal unit 54*a* in the fifth embodiment is a conductor line assembly constituted by plural conductor lines twisted together. The conductor line assembly is formed by pressing plural conductor lines twisted together, for example. The side surfaces of the individual conductor lines are covered with a coating layer 54*c* so that the conductor lines insulate from each other. The first metal unit 54*a* is formed so that the widths of the individual conductor lines in a direction substantially perpendicular to the longitudinal direction, which is the extension direction of the conductor lines, become substantially uniform and also that the thicknesses of the conductor lines in the same direction become substantially uniform. The first metal unit 54*a* is embedded in the base body 2 so that both ends of the first metal unit 54*a* in the longitudinal direction are located at positions having substantially the same distance from the bottom surface 2*b* of the base body 2. The first metal unit 54*a* constituted by the conductor line assembly serves as a coil conductor in the inductor 51. The length of the first metal unit 54*a* is substantially the same as that of the base body 2. The width of the first metal unit 54*a* is shorter than that of the base body 2.

(Advantages)

Focusing on skin lines 58, indicated by the long dashed dotted lines in FIG. 7, corresponding to the skin of the multiple conductor lines forming the first metal unit 54*a*, and external shape lines 56 of the first metal unit 54*a* indicated by the broken lines in FIG. 7, the entire length of the skin lines 58 is found to be longer than that of the external shape lines 56. That is, the first metal unit 54*a* configured as described above can increase its surface area to be larger than a first metal unit constituted by one metal plate having substantially the same external shape as the first metal unit 54*a*. The first metal unit 54*a* can thus reduce the electrical resistance. The surface area of the first metal unit 54*a* can be increased while the size of the sectional area is substantially maintained, so that the electrical resistance can be reduced without decreasing the inductance L.

EXAMPLES

Figure 8:
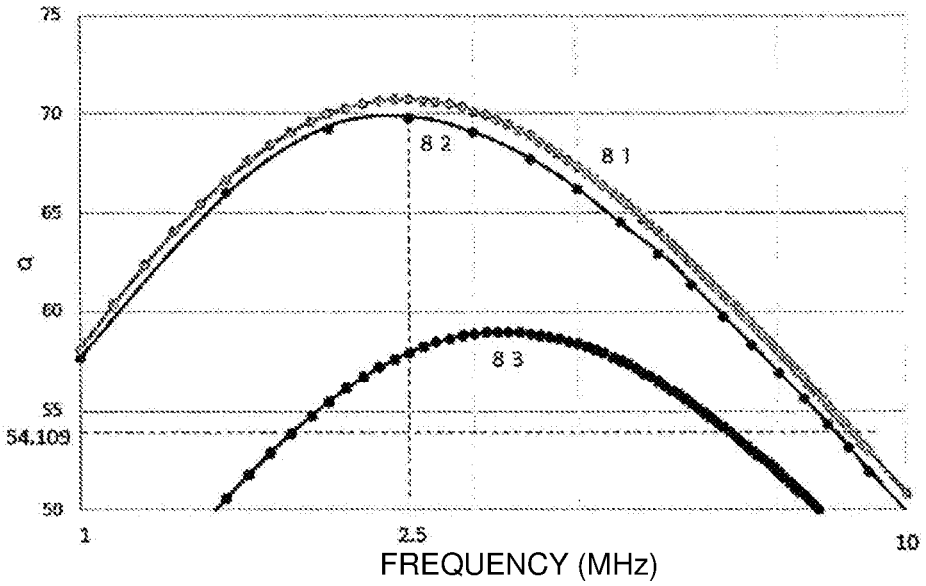
FIG. 8 is a graph illustrating the Q factors of inductors according to embodiments of the disclosure with respect to the frequency in comparison with the Q factor of a known inductor.

FIG. 8 is a graph illustrating the Q factors of inductors with respect to the frequency. The inductors represented by the graph of FIG. 8 have different lengths of the external shape lines of first metal units in the widthwise direction and different areas surrounded by the external shape lines. In FIG. 8, the horizontal axis represents the frequency [Hz] and the vertical axis represents the Q factor.

A solid line 81 indicates the Q factor of the inductor 41 according to the fourth embodiment with respect to the frequency. In the inductor 41, the thickness of the first metal unit 44*a* is about 135 μm and the width is about 700 μm. In the first metal unit 44*a*, one slit having a width of about 100 μm is formed. The area surrounded by the external shape lines 46 is thus about 94500 $\mu m^2$. and the entire length of the external shape lines 46 is thus about 1670 μm.

A solid line 82 indicates the Q factor of the inductor 21 according to the second embodiment with respect to the frequency. In the first metal unit 24*a*, two metal plates, each having a thickness of about 67.5 μm and a width of about 600 μm, are used, and an insulating member having a thickness of about 10 μm is disposed between the two metal plates. The resulting first metal unit 24*a* has a thickness of about 145 μm and a width of about 600 μm. The area surrounded by the external shape lines 26 is thus about 87000 $\mu m^2$. and the entire length of the external shape lines 26 is thus about 1490 μm.

A solid line 83 indicates the Q factor of a known inductor with respect to the frequency. In the known inductor, the thickness of a first metal unit is about 90 μm and the width is about 400 μm. The area surrounded by the external shape lines is thus about 36000 $\mu m^2$. and the entire length of the external shape lines is thus about 980 μm.

In the case of the inductor 41 represented by the solid line 81, the entire length of the skin lines 48 is longer than that of the external shape lines 46 by about 4%. In the case of the inductor 21 represented by the solid line 82, the entire length of the skin lines 28 is longer than that of the external shape lines 26 by about 79%.

It is observed from the above-described results that the Q factors of the inductors 21 and 41 according to the second and fourth embodiments are higher than that of the known inductor. It is also observed that the Q factors of the inductors 21 and 41 are maximized when the frequency is about 2.5 MHz, that is, in a frequency range exceeding 1 MHz. Hence, the inductors according to the embodiments of the disclosure achieve high Q factors with respect to a frequency as high as about 2.5 MHz.

Each of the inductors 21, 31, 41, and 51 configured as described above includes a base body and a metal body. The base body contains magnetic powder. The metal body includes first and second metal units. The first metal unit passes through inside the base body. The second metal unit is continuously provided from both ends of the first metal unit and protrudes from the base body to outside. The second metal unit is used as an outer electrode. In a cross section cut along a direction substantially perpendicular to the longitudinal direction of the first metal unit, the entire length of skin lines corresponding to the skin of a conductor forming the first metal unit is longer than that of external shape lines of the first metal unit by about 4% or greater.

MODIFIED EXAMPLES

The first metal unit 34*a* of the inductor 31 according to the third embodiment is constituted by one metal plate having the grooves 32 formed therein. Likewise, the first metal unit 44*a* of the inductor 41 according to the fourth embodiment is constituted by one metal plate having the slits 42 formed therein. However, these configurations of the first metal units 34*a* and 44*a* are only examples. As in the first metal unit 24*a* of the inductor 21 according to the second embodiment, plural metal plates having the grooves 32 may be stacked on each other to form the first metal unit 34*a*, and plural metal plates having the slits 42 may be stacked on each other to form the first metal unit 44*a*.

In the first metal units 34*a* and 44*a* of the inductors 31 and 41, the grooves 32 and the slits 42 having substantially the same lengths as those of the first metal units 34*a* and 44*a*, respectively, are provided. However, this configuration is only an example. Grooves shorter than the length of the first metal unit 34*a* or slits shorter than the length of the first metal unit 44*a* may be formed.

The first metal unit 54*a* of the inductor 51 according to the fifth embodiment may be formed by pressing plural conductor lines having the shape of a circle in cross section or by plural conductor lines having the shape of a rectangle or a polygon, for example, in cross section.

The details of the configurations disclosed in the above-described embodiments and examples may be modified, and the combinations and orders of the elements may be changed without departing from the scope and spirit of the disclosure.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor comprising:

a base body containing magnetic powder; and a metal body including first and second metal units, the first metal unit passing through inside the base body, the second metal unit being continuously provided from both ends of the first metal unit and protruding from the base body to outside, wherein the second metal unit defines an outer electrode, and in a cross section cut along a direction substantially perpendicular to a longitudinal direction of the first metal unit, a length of external shape lines of a sectional configuration of the first metal unit is about 1000 μm to 1800 μm, and an area surrounded by the external shape lines is about 40000 $\mu m^2$ to 112500 $\mu m^2$.

2. An inductor comprising:

a base body containing magnetic powder; and a metal body including first and second metal units, the first metal unit passing through inside the base body, the second metal unit being continuously provided from both ends of the first metal unit and protruding from the base body to outside, wherein the second metal unit defines an outer electrode, and in a cross section cut along a direction substantially perpendicular to a longitudinal direction of the first metal unit, an entire length of skin lines corresponding to a skin of a conductor constituting the first metal unit is longer than an entire length of external shape lines of the first metal unit by about 4% or greater.

3. The inductor according to claim 1, wherein the first metal unit comprises a plurality of conductors stacked on each other.

4. The inductor according to claim 1, wherein the first metal unit has a slit extending in the longitudinal direction of the first metal unit.

5. The inductor according to claim 1, wherein the first metal unit has a groove extending in the longitudinal direction of the first metal unit.

6. The inductor according to claim 1, wherein the first metal unit is a conductor line assembly comprising a plurality of conductor lines twisted together.

7. The inductor according to one of claim 1, wherein a dimension of at least a portion of the second metal unit in a direction substantially perpendicular to a longitudinal direction of the second metal unit is greater than a dimension of the first metal unit in a direction substantially perpendicular to the longitudinal direction of the first metal unit.

8. The inductor according to claim 2, wherein the first metal unit comprises a plurality of conductors stacked on each other.

9. The inductor according to claim 2, wherein the first metal unit has a slit extending in the longitudinal direction of the first metal unit.

10. The inductor according to claim 3, wherein the first metal unit has a slit extending in the longitudinal direction of the first metal unit.

11. The inductor according to claim 8, wherein the first metal unit has a slit extending in the longitudinal direction of the first metal unit.

12. The inductor according to claim 2, wherein the first metal unit has a groove extending in the longitudinal direction of the first metal unit.

13. The inductor according to claim 3, wherein the first metal unit has a groove extending in the longitudinal direction of the first metal unit.

14. The inductor according to claim 8, wherein the first metal unit has a groove extending in the longitudinal direction of the first metal unit.

15. The inductor according to claim 2, wherein the first metal unit is a conductor line assembly comprising a plurality of conductor lines twisted together.

16. The inductor according to one of claim 2, wherein a dimension of at least a portion of the second metal unit in a direction substantially perpendicular to a longitudinal direction of the second metal unit is greater than a dimension of the first metal unit in a direction substantially perpendicular to the longitudinal direction of the first metal unit.

17. The inductor according to one of claim 3, wherein a dimension of at least a portion of the second metal unit in a direction substantially perpendicular to a longitudinal direction of the second metal unit is greater than a dimension of the first metal unit in a direction substantially perpendicular to the longitudinal direction of the first metal unit.

18. The inductor according to one of claim 8, wherein a dimension of at least a portion of the second metal unit in a direction substantially perpendicular to a longitudinal direction of the second metal unit is greater than a dimension of the first metal unit in a direction substantially perpendicular to the longitudinal direction of the first metal unit.

19. The inductor according to one of claim 4, wherein a dimension of at least a portion of the second metal unit in a direction substantially perpendicular to a longitudinal direction of the second metal unit is greater than a dimension of the first metal unit in a direction substantially perpendicular to the longitudinal direction of the first metal unit.

20. The inductor according to one of claim 9, wherein a dimension of at least a portion of the second metal unit in a direction substantially perpendicular to a longitudinal direction of the second metal unit is greater than a dimension of the first metal unit in a direction substantially perpendicular to the longitudinal direction of the first metal unit.

* * * * *